US006743062B1

(12) United States Patent
Jones

(10) Patent No.: US 6,743,062 B1
(45) Date of Patent: Jun. 1, 2004

(54) BRAKING SYSTEM FOR JET-PROPELLED BOAT

(75) Inventor: James R. Jones, Neosho, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 343 days.

(21) Appl. No.: 09/724,237

(22) Filed: Nov. 28, 2000

(51) Int. Cl.[7] ..... B63H 11/00
(52) U.S. Cl. ..... 440/38; 440/41
(58) Field of Search ..... 440/1, 84–87, 440/38, 41, 42, 40

(56) References Cited

U.S. PATENT DOCUMENTS 5,474,007 A * 12/1995 Kobayashi ..... 440/42
5,562,066 A * 10/1996 Gere et al. ..... 114/270
5,607,332 A * 3/1997 Kobayashi et al. ..... 440/41
5,755,601 A 5/1998 Jones ..... 440/41

* cited by examiner

*Primary Examiner*—Ed Swinehart
(74) *Attorney, Agent, or Firm*—Ziolkowski Patent Solutions Group, LLC

(57) ABSTRACT

A method and an apparatus for braking a jet-propelled boat. The method comprises the steps of deploying a reverse gate and then opening a throttle of an engine in response to actuation of a brake pedal. The system comprises an engine having a throttle, a water jet propulsion system, a reverse gate, a brake pedal, and a mechanical system for deploying the reverse gate and then opening the throttle in response to the brake pedal being actuated by the boat operator. The reverse gate is deployed when the brake pedal is moved from a first position to a second position and the throttle is opened as the brake pedal is moved from the second position to a third position.

19 Claims, 8 Drawing Sheets

| FIG.2A | FIG.2B |
|---|---|

BRAKING SYSTEM FOR JET-PROPELLED BOAT

FIELD OF THE INVENTION

This invention generally relates to water jet apparatus for propelling boats and other watercraft. In particular, the invention relates to mechanisms for braking a water jet-propelled boat or other watercraft.

BACKGROUND OF THE INVENTION

It is known to provide a mechanism for reversing the direction of the water flow exiting the steering nozzle of a water jet propulsion system. The reverse gate is typically pivotable about a horizontal axis between up and down positions. In the up position, the reverse gate is clear of the water flow exiting the steering nozzle. In the down position, the reverse gate is disposed in the path of the exiting water flow. In its simplest embodiment, the reverse gate has a U-shaped channel which reverses the water flow exiting the steering nozzle.

It would be desirable if a boat or watercraft operator could use the reverse gate as a brake when the boat is moving forward and needs to be stopped quickly. However, in order to accomplish this, what is needed is a system for deploying the reverse gate and then opening the throttle in sequence, both actions occurring in response to the same mechanical operation. Opening of the throttle must be delayed until after the reverse gate has been fully deployed. When the throttle is opened, the engine drives the impeller of the water jet propulsion system, impelling water rearward. The reverse gate in the fully deployed position reverses the flow discharged from the steering nozzle, producing a reverse thrust which causes the forward-moving boat to decelerate.

There is a need for a braking system for a jet-propelled boat or other watercraft which has no electronic components, since electronic components have reduced reliability in aquatic environments.

SUMMARY OF THE INVENTION

The present invention is directed to a method and an apparatus for braking a jet-propelled boat. The method in accordance with the preferred embodiments comprises the steps of deploying a reverse gate and then opening a throttle of an engine in response to actuation of a brake pedal. The system in accordance with the preferred embodiments comprises an engine having a throttle, a water jet propulsion system, a reverse gate, a brake pedal, and a mechanical system for deploying the reverse gate and then opening the throttle in response to the brake pedal being actuated by the boat operator. More specifically, the reverse gate is deployed when the brake pedal is moved from a first position to a second position and the throttle is opened as the brake pedal is moved from the second position to a third position. In the preferred embodiment, the brake pedal is pivotably mounted and both movements of the brake pedal are pivoting motions.

The invention is another aspect is directed to a system for actuating a reverse gate. The preferred embodiments of such a system comprise a brake pedal, a brake cable having one end coupled to the brake pedal, a pivotable control lever having a portion coupled to the other end of the brake cable, and an actuating rod having one end coupled to the control lever and the other end coupled to the reverse gate. The system further comprises a spring which does not compress until at least a threshold compressive force is applied which is greater than the load required to actuate the reverse gate. In accordance with one preferred embodiment, the actuating rod is coupled to the control lever via the spring. In accordance with another preferred embodiment, the brake cable is coupled to the control lever via the spring. Once the reverse gate is fully deployed, the actuating rod which actuated deployment is stopped. The spring is designed to allow the brake cable to continue to be displaced after reverse gate deployment. This further brake cable displacement is used to open an engine throttle. This is accomplished using a slave cable which is coupled to the engine throttle and slaved to the brake cable.

In accordance with one preferred embodiment of the invention, the mechanical system linking the reverse gate to the brake pedal comprises a pivotable control lever having a first range of pivoting while the brake pedal moves from the first position to the second position and a second range of pivoting while the brake pedal moves from the second position to the third position. The mechanical system further comprises an actuating rod which displaces in response to the control lever pivoting in the first range and which does not displace during pivoting of the control lever in the second range. The actuating rod is coupled to the reverse gate.

In accordance with another preferred embodiment of the invention, the mechanical system linking the reverse gate to the brake pedal comprises a brake cable having a first range of displacement while the brake pedal moves from the first position to the second position and a second range of displacement while the brake pedal moves from the second position to the third position. In addition, the mechanical system comprises a pivotable control lever which pivots in response to the brake cable displacing in the first range and which does not pivot during displacement of the brake cable in the second range. An actuating rod has one end coupled to the control lever and the other end coupled to the reverse gate.

In accordance with a further preferred embodiment of the invention, the mechanical system comprises: a brake cable having a first range of displacement while the brake pedal moves from the first position to the second position and a second range of displacement while the brake pedal moves from the second position to the third position; a slave cable which is slaved to the brake cable; and a mechanical element which is attached to one end of the slave cable. The mechanical element is coupled to a throttle during displacement of the brake cable in the second range but not in the first range.

In its broadest aspect, the invention is directed to a jet-propelled boat comprising a brake pedal and a reverse gate actuated by the brake pedal. The preferred embodiment further comprises a throttle pedal and an engine throttle actuated by the throttle pedal. In addition, the engine throttle can be actuated by the brake pedal during the braking operation. The preferred embodiments further comprise a mechanical system for actuating the reverse gate in response to actuation of the brake pedal and delaying actuation of the engine throttle until after actuation of the reverse gate. Preferably, the mechanical system comprises a spring arranged so that a compressive force is applied to the spring when the brake pedal is actuated, the spring having a sufficiently high spring rate that the spring does not compress until at least a threshold compressive force is applied via the brake pedal. This threshold compressive force is greater than the load required to actuate the reverse gate. Further, the mechanical system comprises a slave cable which couples the engine throttle to the brake pedal after execution of a range of lost motion.

DETAILED DESCRIPTION OF THE PREFERRED EMBODIMENTS

Figures 1, 1A, 1B:
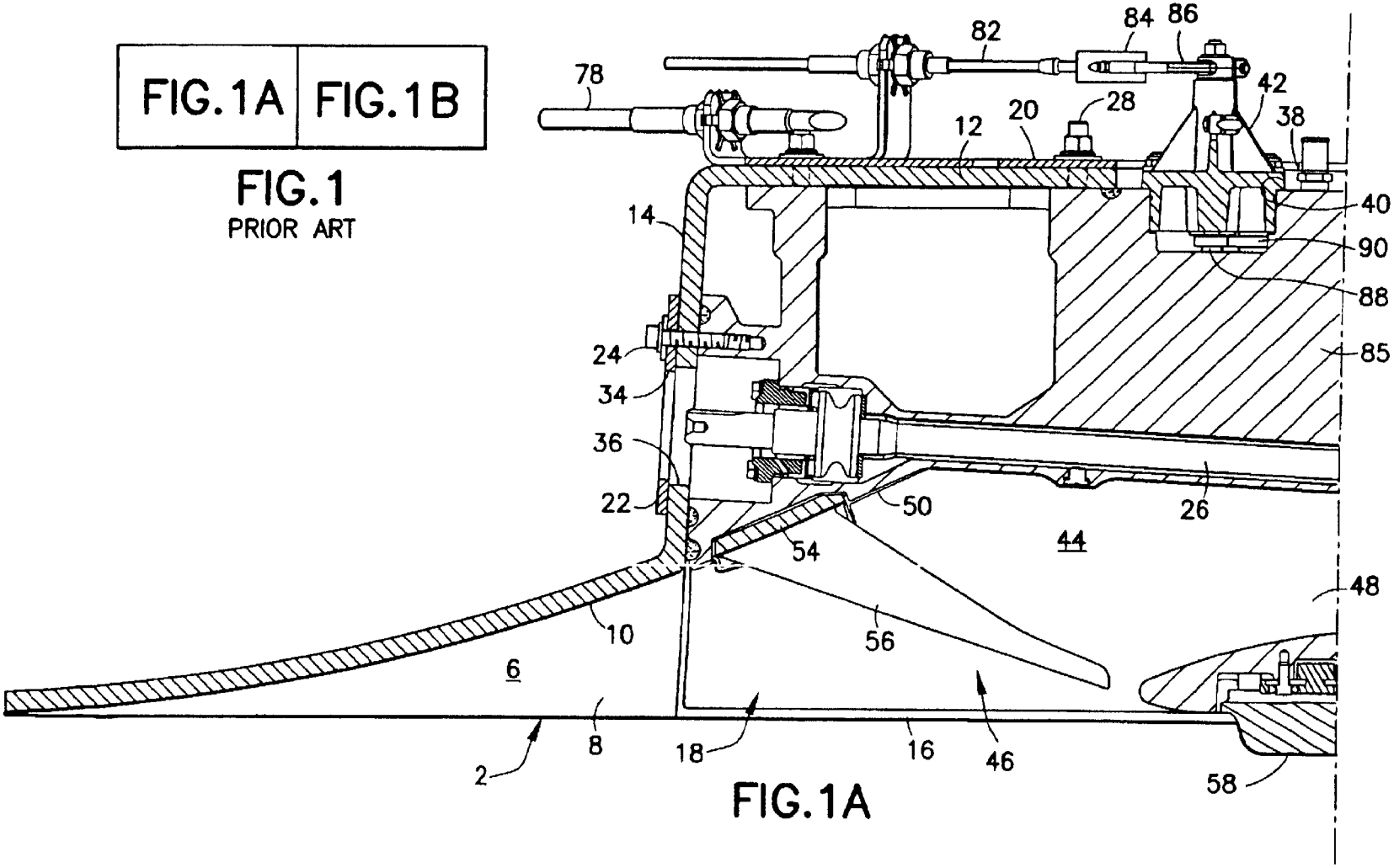
FIG.1 PRIOR ART
FIG. 1 is a schematic (presented in two sheets respectively labeled FIGS. 1A and 1B) showing a sectional view of a prior water jet propulsion system mounted to a boat hull, the section being taken along a vertical midplane.
Figure 1B:
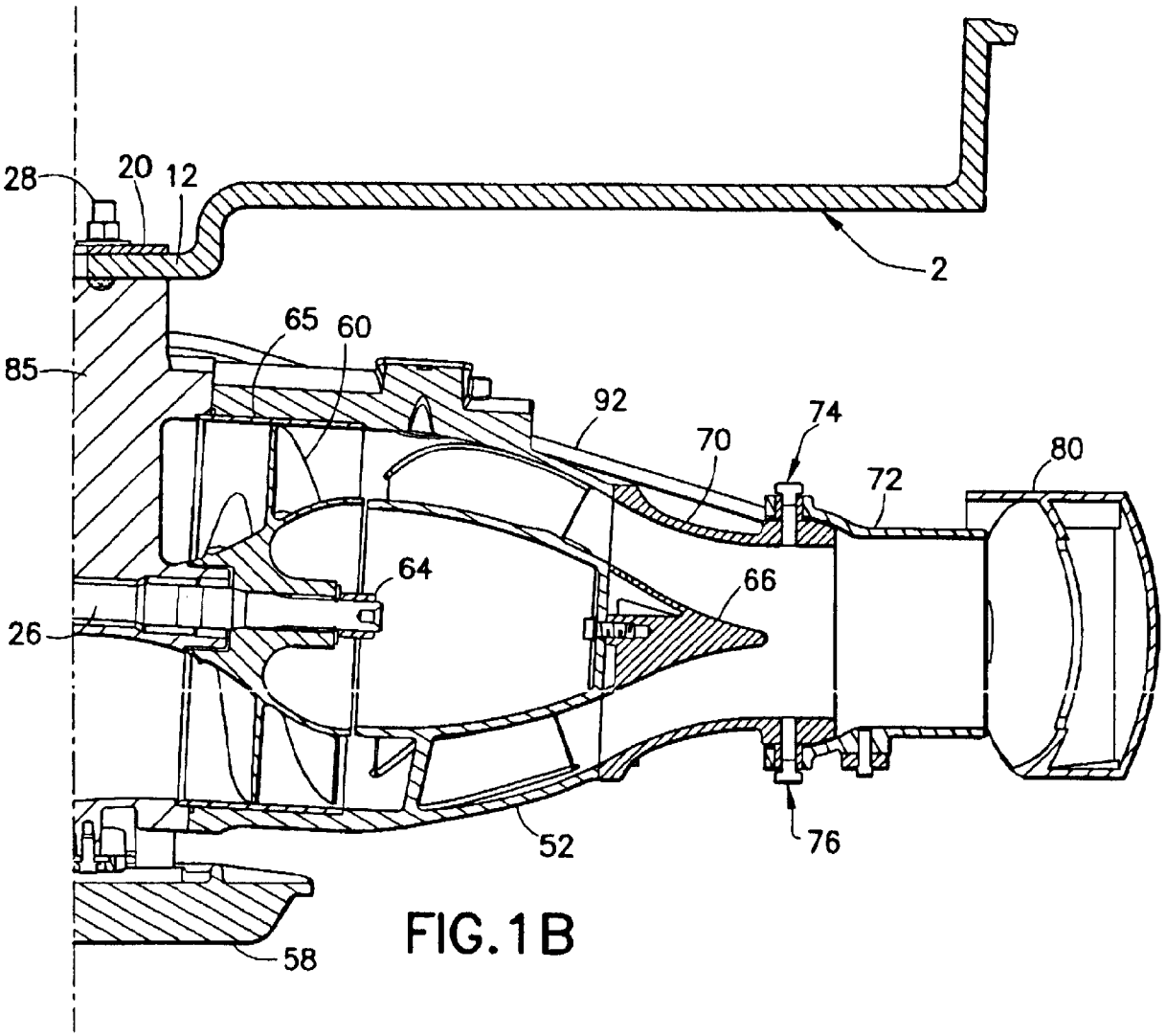
Figures 2, 2A:
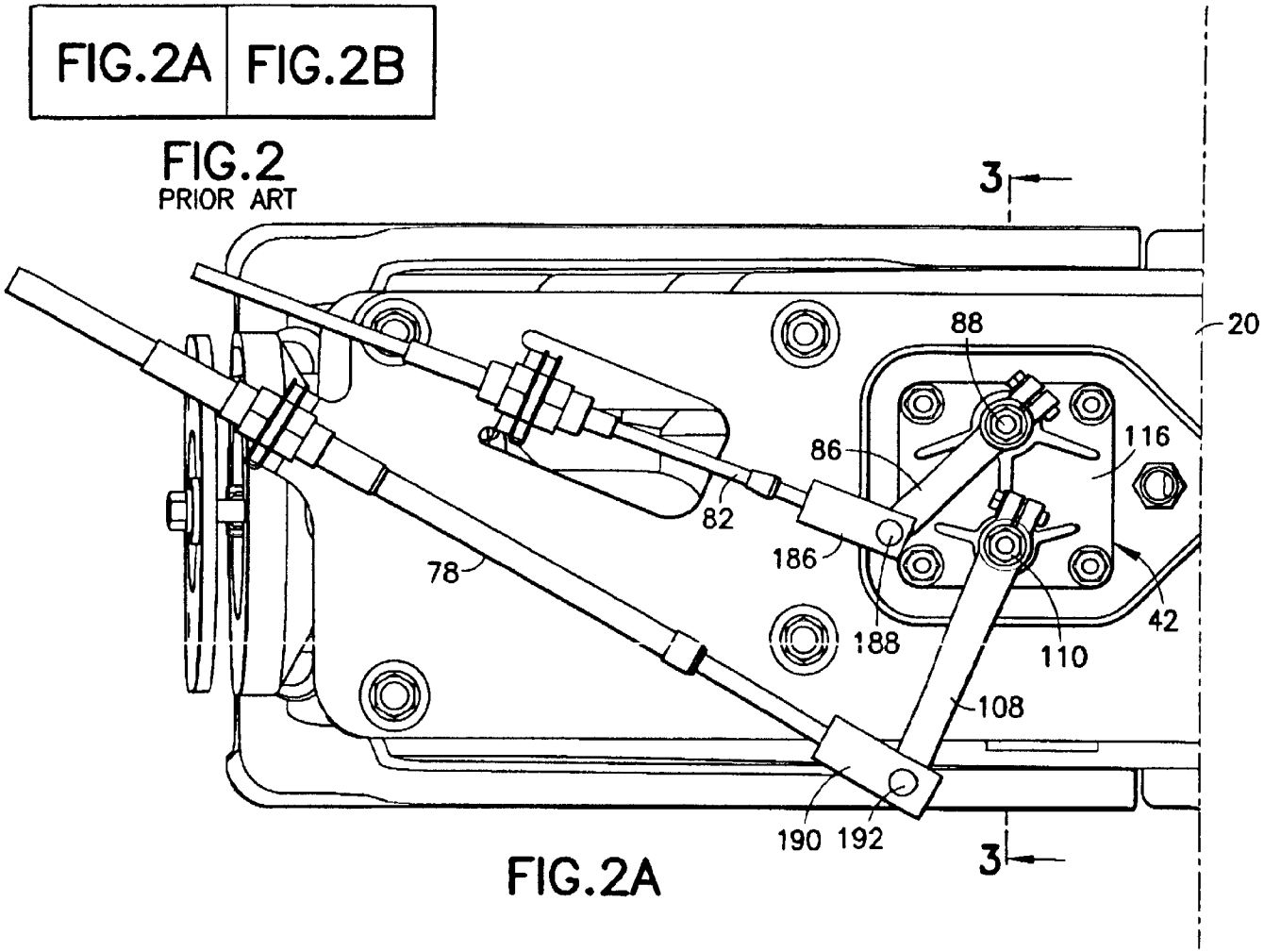
FIG.2 PRIOR ART
FIG. 2 is a schematic (presented in two sheets respectively labeled FIGS. 2A and 2B) showing a top view of the top mounting plate and the water jet apparatus depicted in FIG. 1, with the hull removed.
Figure 3:
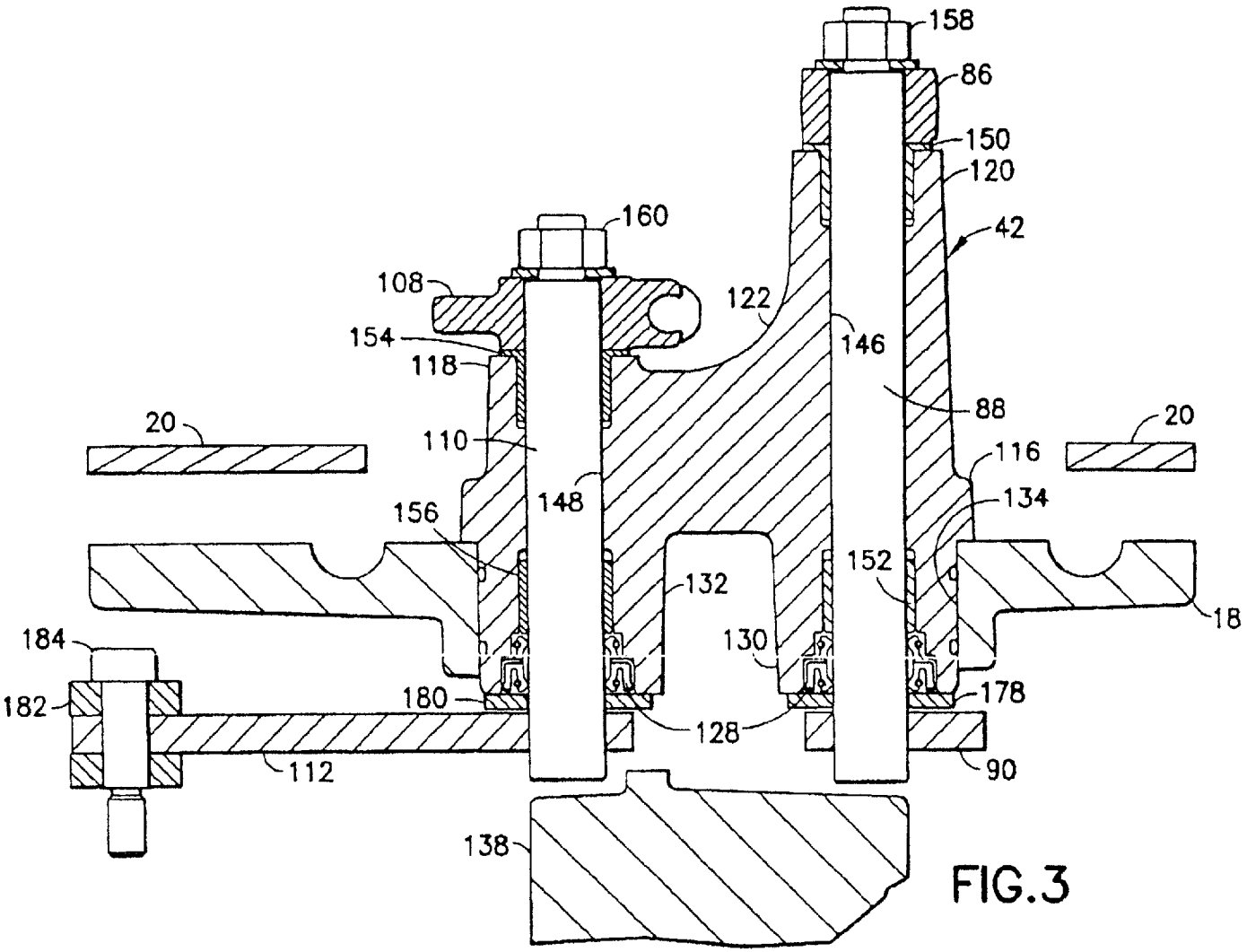
FIG. 3 is a schematic showing a sectional view of the shifting and steering control housing shown in FIG. 2A, the section being taken along line 3—3 in FIG. 2A.

FIGS. 1–3 are presented for the purpose of disclosing exemplary mechanisms for enabling a boat operator to remotely control the positions of a steering nozzle and a reverse gate. FIGS. 1–3 merely present one example of a water jet propulsion system, and do not show a reverse gate which has been optimized for braking. A reverse gate which has been optimized for braking is the subject of concurrently filed U.S. patent application Ser. No. 09/928,638, now U.S. Pat. No. 6,428,370 B1, to the same inventor and assigned to the same assignee. Such a reverse gate is ideally suited for use in the braking system disclosed herein because it requires a relatively low operating load and therefore can be quickly deployed. However, the braking system of the present invention can use reverse gates other than those disclosed in the aforementioned co-pending U.S. patent application. The braking system in accordance with the preferred embodiments of the invention will be described in detail later with reference to FIGS. 4–7.

As seen in FIG. 1, the boat hull 2 has an inlet ramp 6 formed by a pair of opposing sidewalls 8 (only one of which is visible in FIG. 1) and a guide surface or ceiling 10 which curves gently upward in the aft direction. The end of the inlet ramp 6 communicates with a cavity in which the water jet propulsion apparatus is installed. This cavity is defined by a horizontal hull section 12, a vertical hull section 14 and a pair of opposing sidewalls 16 (only one of which is visible in FIG. 1), the cavity being open at the bottom and rear to allow insertion of the water jet propulsion apparatus.

The apparatus depicted in FIG. 1 comprises an inlet housing 18, which is slid into the aforementioned cavity and bolted to the hull by means of a top mounting plate 20 and a front plate 22. At the time of inlet housing installation, the drive shaft 26 is already rotatably mounted in the inlet housing. In particular, the inlet housing 18 comprises a vertical strut 85 having an axial bore which houses a portion of the drive shaft. During inlet housing installation, the front plate 22 is placed on the inside of the vertical hull section 14 and the inlet housing 18 is placed on the outside of vertical hull section 14. Screws 24 (only one of which is visible in FIG. 1) hold the front plate, vertical hull section and inlet housing together. The front plate 22 has an opening 34 (best seen in FIG. 2) which, in the assembled state, is aligned with an opening 36 in the vertical hull section 14 to allow the output shaft (not shown) from the inboard motor to be coupled to the front end of the drive shaft 26. The studs 28 are affixed to the inlet housing 18. The inlet housing 18 is inserted into the hull cavity and the studs 28 are inserted into throughholes in the hull. The front plate 22 is then positioned and screws 24 are screwed into the inlet housing 18. The top mounting plate 20 is then placed over the studs 28 and secured to the hull. The top mounting plate 20 has an opening 38 which, in the assembled state, is aligned with an opening 40 in the horizontal hull section 12 to allow a shifting and steering control housing 42 to be placed in a corresponding opening in the top wall of the inlet housing 18.

The inlet housing 18 has a water tunnel 44 with an inlet 46. The water tunnel 44 comprises a pair of sidewalls 48 (only one of which is shown in FIG. 1) which are generally coplanar with the sidewalls 8 of the hull inlet ramp 6. In addition, water tunnel 44 comprises a guide surface 50 which starts at a point near where the guide surface 10 of the hull inlet ramp 6 ends and then curves gradually upward in the aft direction. The hull 2 and the inlet housing 18 combine to form a single inlet for guiding water toward the inlet of a stator housing 52 located downstream of the inlet housing. An inlet grate 54, comprising a multiplicity of generally parallel tines 56, extends across the inlet 46 to prevent debris from entering. In addition, a ride plate 58 is attached to the bottom of the inlet housing 18.

As shown in FIG. 1, the drive shaft projects in the aft direction out of the inlet housing 18. The impeller is pre-assembled in the unit prior to mounting in the hull. The hub and blades of impeller 60 are preferably integrally formed as one cast piece. The hub of impeller 60 has a splined bore which meshes with splines formed on the external surface of the drive shaft 26, so that the impeller 60 will rotate in unison with the drive shaft. The impeller 60 is held on a threaded end of the drive shaft 26 by a threaded nut 64.

The stator housing 52 comprises inner and outer shells connected by a plurality of stator vanes, all integrally formed as a single cast piece. The stator vanes are designed to redirect the swirling flow out of the impeller 60 into non-swirling flow. A tail cone cover 66 is attached to the radial end face of the stator housing hub. The front of the stator housing 52 is then attached to the rear of the inlet housing 18. A circumferential recess in the stator housing 52 at a position opposing the impeller blade tips has a circular cylindrical wear ring 65 seated therein.

An exit nozzle 70 is attached to and in flow communication with the stator housing 52. Water from the stator housing 52 flows through the space between the tail cone cover 66 and the exit nozzle 70. A steering nozzle 72 is pivotably mounted to the exit nozzle 70 by a pair of pivot assemblies 74 and 76 having collinear axes. The steering nozzle 72 can be turned to change the direction of the water being discharged from the exit nozzle 70.

Figure 2B:
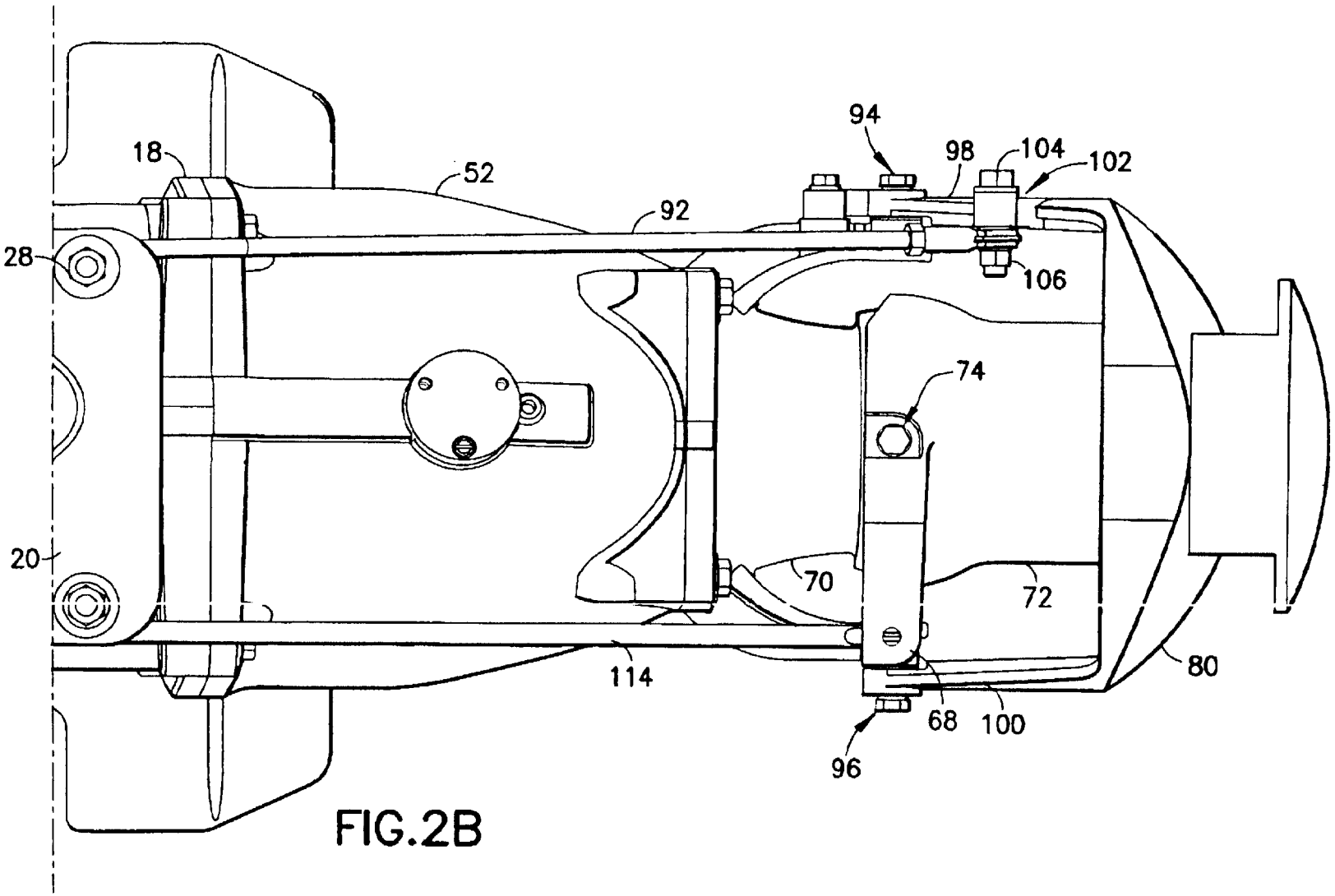

As best seen in FIG. 2B, the steering nozzle 72 has an arm 68 which is pivotably coupled to a flattened end of a steering rod 114. Displacement of the steering rod 114 in response to operation of a steering cable assembly 78 (see FIG. 2A) causes the steering nozzle 72 to swing in a desired direction about its vertical pivot axis.

The water jet apparatus is further provided with a non-steerable reverse gate 80, seen in FIG. 2B. In the forward position, the reverse gate 80 is raised, thereby allowing water to exit the steering nozzle 72 freely. In the reverse position, the reverse gate 80 is lowered to a position directly opposite to the outlet of the steering nozzle 72. The reverse gate is designed to partially reverse the flow of water exiting the steering nozzle 72 when the reverse gate is in the reverse position. To accomplish the foregoing, the arms 98 and 100 of the reverse gate 80 are pivotably mounted to a pair of pivot assemblies 94 and 96 located on opposite sides of the exit nozzle 70 (see FIG. 2B). The support arms 98 and 100 are rigid members which connect to the exit nozzle 70. The reverse gate 80 is pivoted by a shift rod 92, the end of which is coupled to arm 98 of the reverse gate 80 by means of a rod end assembly 102 which comprises a ball socket for allowing horizontal radial motion at the shifting control lever and vertical radial motion at the reverse gate. The rod end assembly is attached to arm 98 by means of a screw 104 and a lock nut 106. Displacement of the shift rod 92 in response to operation of a shifting cable assembly 82 (see FIG. 2A) causes the reverse gate to swing in a desired direction, namely, into forward position or reverse position, with a "neutral" position therebetwen.

In the apparatus depicted in FIGS. 1 and 2, the shift and steering cable assemblies (located inside the hull) are respectively coupled to shift and steering rods (located outside the hull) by means of respective lever and shaft assemblies rotatably supported in a shifting and steering control housing 42 which penetrates the hull. The shifting and steering control housing 42 is installed in a corresponding opening in the top of the inlet housing 18. As seen in FIG. 2A, the housing 42 preferably comprises a base plate 116. As best seen in FIG. 3, the housing 42 further comprises an upper vertical tubular structures 118 and 120 extending above the base plate to different heights. The tubular structures 118 and 120 are reinforced by a rib 122. Additional reinforcement is provided by respective pairs of ribs, visible in FIG. 2A. Referring again to FIG. 3, below the base plate 116, the housing has a circular cylindrical lower wall 128 integrally formed with lower vertical tubular structures 130 and 132. The lower wall 128 slides into a circular opening formed in the top wall of the inlet housing 18. The opening in the inlet housing communicates with the exterior of the water jet apparatus via a pair of opposing side channels through which the lower shift and steering control levers (described below) respectively pass. Preferably the opening 40 (see FIG. 1A) in the horizontal hull section 12 closely matches the opening in mounting plate. As seen in FIG. 2A, the housing 42 is bolted to the inlet housing 18.

As seen in FIG. 3, the shifting and steering control housing 42 has one bore 146 for receiving the shifting shaft 88 and another bore 148 for receiving the steering shaft 110. The bore 146 has upper and lower annular recesses in which upper and lower bushings 150 and 152 are respectively inserted; the bore 148 has upper and lower annular recesses in which upper and lower bushings 154 and 156 are respectively inserted. The shifting shaft 88 is rotatably supported in bushings 150 and 152, while steering shaft 110 is rotatably supported in bushings 154 and 156. One end of the upper shifting control lever 86 is secured to the top of the shifting shaft 88 by means of a lock nut 158 which screws onto a threaded end of the shifting shaft; one end of the upper steering control lever 108 is secured to the top of the steering shaft 110 by means of a lock nut 160 which screws onto a threaded end of the steering shaft. (Only a portion of each of the upper levers is shown in FIG. 3.) The upper levers bear on the flanges of the upper bushings during rotation of the lever and shaft assemblies.

Still referring to FIG. 3, a lower shifting control lever 90 is welded to the bottom of the shifting shaft 88, while a lower steering control lever 112 is welded to the bottom of the steering shaft 110. A lower washer 178 is installed between the lower shifting control lever 90 and the lower vertical tubular structure 130 of the shifting and steering control housing 42, while a lower washer 180 is installed between the lower steering control lever 112 and the lower vertical tubular structure 132 of housing 42. The washers 178 and 180 provide a bearing surface. During assembly, the bottoms of the shafts are supported by a boss 138. The full length of the lower steering control lever 112 is shown in FIG. 3, while only a portion of the lower shifting control lever 90 is depicted. FIG. 3 shows a clevis 182 and a shoulder screw 184 for attaching the distal end of the lower steering control lever 112 to the forward end of the steering rod (not shown in FIG. 3). Similarly, the distal end of the lower shifting control lever is attached to the forward end of the shift rod by means of a clevis and shoulder screw coupling (not shown in FIG. 3).

Referring to FIG. 2A, the distal end of the upper shifting control lever 86 is attached to the shifting cable assembly 82 by means of a clevis 186 and a clevis pin 188. These components are located inside the hull of the boat (see FIG. 1A). Displacement of the end of the shifting cable assembly causes the shifting control lever and shaft assembly to rotate. Likewise the distal end of the upper steering control lever 108 is attached to the steering cable assembly 78 by means of a clevis 190 and a clevis pin 192, and displacement of the end of the steering cable assembly causes the steering control lever and shaft assembly to rotate. As best seen in FIG. 1A, the shifting cable assembly 82 is supported by a bracket 194 and the steering cable assembly 78 is supported by a bracket 196, both brackets being integrally connected to and extending vertically upward from the top mounting plate 20. In response to operation of the steering cable assembly 78, the steering nozzle can be selectively turned left or right to steer the boat as desired during water jet operation. In response to operation of the shifting cable assembly 82, the reverse gate can be selectively raised or lowered.

In accordance with the preferred embodiments of the invention, the reverse gate is pivotably mounted to the exit nozzle, and is pivotable between first and second shift positions. The reverse gate in the first shift position is removed from the path of water exiting the exit nozzle and in the second shift position is disposed in the path of water exiting the exit nozzle. The basic principle of reverse gate design is that if a planar surface (flat or contoured) is positioned aft of the pump discharge, the resulting diffusion is a 360-degree fan-out pattern. Contouring the planar surface will (to varying degrees) alter the fan-out pattern, but in general the more the discharge is managed, the more it is restricted. Greater restriction will cause the impeller to stall at lower rpm. Also, as great amounts of reverse discharge are drawn into the pump inlet, the impeller is more likely to stall at lower rpm due to entrained air. In addition, the deflector surfaces must be defined by a radius or radii that originate at the pivot pin centerline. That pivot centerline must be positioned on the vertical centerline of the exit nozzle. Using these geometric characteristics will balance opening and closing loads. The force required to open or close the gate can be supplemented by addition of features applied to the deflector surface.

The braking systems of the present invention can be employed with the system depicted in FIGS. 1–3 or any other suitable system. The braking systems in accordance with the preferred embodiments of the invention are shown in FIGS. 4–7.

Figure 4:
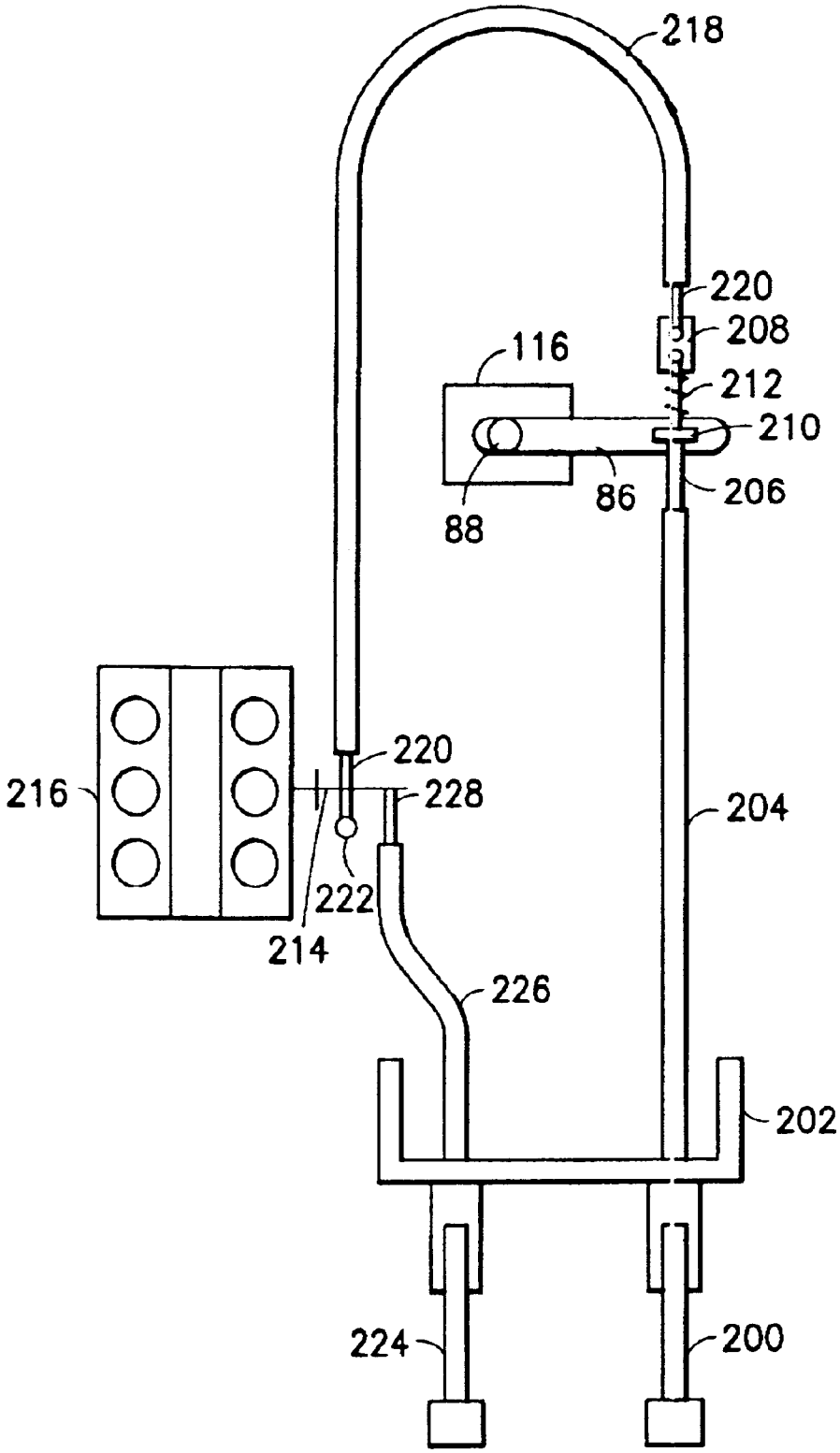
FIG. 4 is a schematic showing a plan view of a braking system in accordance with one preferred embodiment of the invention.

FIG. 4 shows components of a braking system for a jet-propelled boat in accordance with a preferred embodiment of the invention. For the sake of simplicity, the upper shifting control lever 86 and the shifting shaft 88 (which penetrates a horizontal hull section as previously described) are shown without the corresponding upper steering control lever and steering shaft. The base plate of a shifting and steering control housing is again indicated by the numeral 116. Although not shown in FIG. 4, an actuator rod for deploying the reverse gate may be coupled to shifting shaft 88 via a lower shifting control lever.

Figure 7:
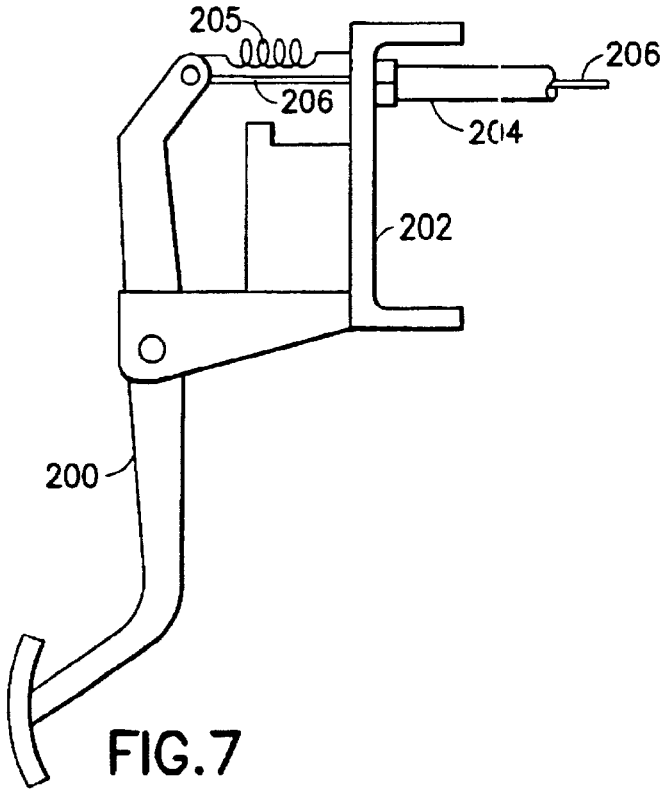
FIG. 7 is a schematic showing a side elevational view of a brake pedal in accordance with the preferred embodiments of the invention.

Referring to FIG. 4, the braking system in accordance with one preferred embodiment comprises a brake pedal 200 which is coupled to the control lever 86 via a brake cable assembly comprising an outer casing 204 and a brake cable core 206. Referring to FIG. 7, the brake pedal 200 is pivotably mounted to a helm control mount 202, which is fixed relative to the boat hull (not shown). One end of the outer casing 204 is anchored to the helm control mount; the other end of the outer casing may be suitably anchored at a location near the base plate. The brake cable 206 is slidable inside the outer casing 204. As seen in FIG. 7, one end of the brake cable 206 is passed through a hole in the helm control mount 202 and connected to the upper end of the brake pedal 200. When the lower end of the brake pedal is pushed down, the upper end of the brake pedal moves away from the helm control mount 202, thereby pulling the brake cable 206 through the outer casing 204. A brake pedal return spring 205 is arranged between the upper end of the brake pedal 200 and the helm control mount 202.

As seen in FIG. 4, the other end of the brake cable 206 is connected to a cable connector 208. The brake cable 206 passes through an opening or slot in a bracket 210 mounted to the pivotable control lever 86. The brake cable 206 is not attached to the bracket 210. In addition, a spring 212 is arranged between the cable connector 208 and the bracket 210. The spring 212 has a high spring rate, i.e., the spring rate is selected so that spring 212 does not compress until a threshold compressive force is applied. In accordance with the preferred embodiments of the invention, the spring is designed to have a threshold compressive force which is greater than the operating load required to deploy the reverse gate, e.g., greater than the operating load required to move the reverse gate from the forward shift position to the reverse shift position.

In accordance with the preferred embodiment shown in FIG. 4, the brake pedal 200 is further coupled to the throttle 214 of an engine 216 via a slave cable assembly comprising a suitably anchored outer casing 218 and a slave cable core 220 slidable in outer casing 218. One end of slave cable 220 is connected to the cable connector 208; the other end of the slave cable 220 passes through an opening or slot in the throttle 214 and has a ball 222 connected to the terminal end thereof. The slave cable 220 moves in unison with the brake cable 206 when the brake pedal 200 is depressed by the boat operator. However, prior to actuation of the brake pedal 200, the ball 222 is separated from the throttle 214 by a predetermined distance representing a distance of lost motion and only engages the throttle after the brake cable 206 has been displaced by a distance equal to that lost motion distance, as will be explained in further detail below. The ball 222 is sized so that it cannot pass through the aforementioned opening or slot in the throttle 214.

Figure 6:
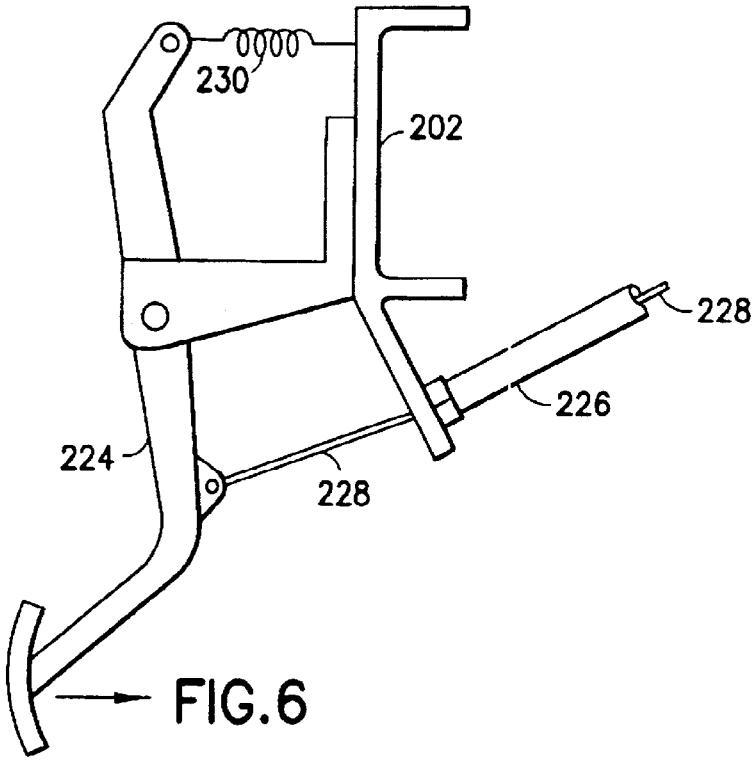
FIG. 6 is a schematic showing a side elevational view of a throttle pedal in accordance with the preferred embodiments of the invention.

The preferred embodiment shown in FIG. 4 further comprises a throttle pedal 224 coupled to the engine throttle 214 via a throttle cable assembly comprising an outer casing 226 and a throttle cable core 228. Referring to FIG. 6, the throttle pedal is pivotably mounted to the helm control unit 202. One end of the outer casing 226 is anchored to the helm control mount 202; the other end of the outer casing may be suitably anchored at a location near the engine throttle. The throttle cable 228 is slidable inside the outer casing 226. As seen in FIG. 6, one end of the throttle cable 228 is passed through a hole in the helm control mount 202 and connected to a lower portion of the throttle pedal 224. When the lower end of the brake pedal is pushed down, the lower portion of the throttle pedal moves toward the helm control mount 202, thereby pushing the throttle cable 228 through the outer casing 226. A throttle pedal return spring 230 is arranged between the upper end of the throttle pedal 224 and the helm control mount 202.

As seen in FIG. 4, the other end of the throttle cable 228 is connected to the engine throttle 214. The degree to which the engine throttle is open can be adjusted by the boat operator using a foot to control the angular position of the throttle pedal 224. The throttle pedal is operated independently of the braking system.

The brake pedal 200 can be operated to quickly deploy the reverse gate in a braking situation. The brake pedal is linked to the reverse gate (not shown in FIG. 4) by the mechanical system comprising brake cable 206, cable connector 208, bracket 210, spring 212, upper shifting control lever 86, shaft 88, a lower shifting control lever and an actuating rod (the latter two being not shown in FIG. 4). In response to the brake pedal being pressed down, the brake pedal pivots, thereby pulling the brake cable 206 forward. The brake cable 206, cable connector 208, throttle cable 220, and spring 212 displace in unison. The ball 222 on the end of the throttle cable 220 is separated from the throttle by a distance which results in lost motion, i.e., the throttle cable 220 displaces without any effect on the engine throttle 214. At the same time, the displacing spring 212 bears against the bracket 210, causing the control lever 86 to pivot and the shaft 88 to turn. This causes the actuating rod (not shown in FIG. 4) to displace rearward and push the reverse gate into the fully down position for reversing the flow of discharged water from the steering nozzle. When the reverse gate reaches the fully down position, further rotation of the reverse gate is stopped. This in turns stops further rotation of the control lever 86, which is mechanically linked to the reverse gate. At about the same time, the ball 222 on the end of the throttle cable 220 engages the throttle 214. At this point, further forward displacement of the brake cable 206 will open the throttle 214. Further forward displacement of the brake cable 206 when the control lever 86 is stopped is made possible by compression of the spring 212. In other words, as the cable connector 208 moves forward with the brake cable 206, it compresses the spring 212 against the stopped bracket 210. Thus, after the reverse gate has been fully deployed, the brake pedal causes the engine to speed up, which in turn speeds up rotation of the impeller to create braking thrust in a manner analogous to reverse thrusters on an airplane.

When the brake pedal is released, the reverse gate and brake pedal are returned to their original positions. The compressed spring 212, the tensioned brake pedal return spring 205 and a return spring at the reverse gate (not shown) all combine to return the system to the original state when the brake pedal is released.

Figure 5:
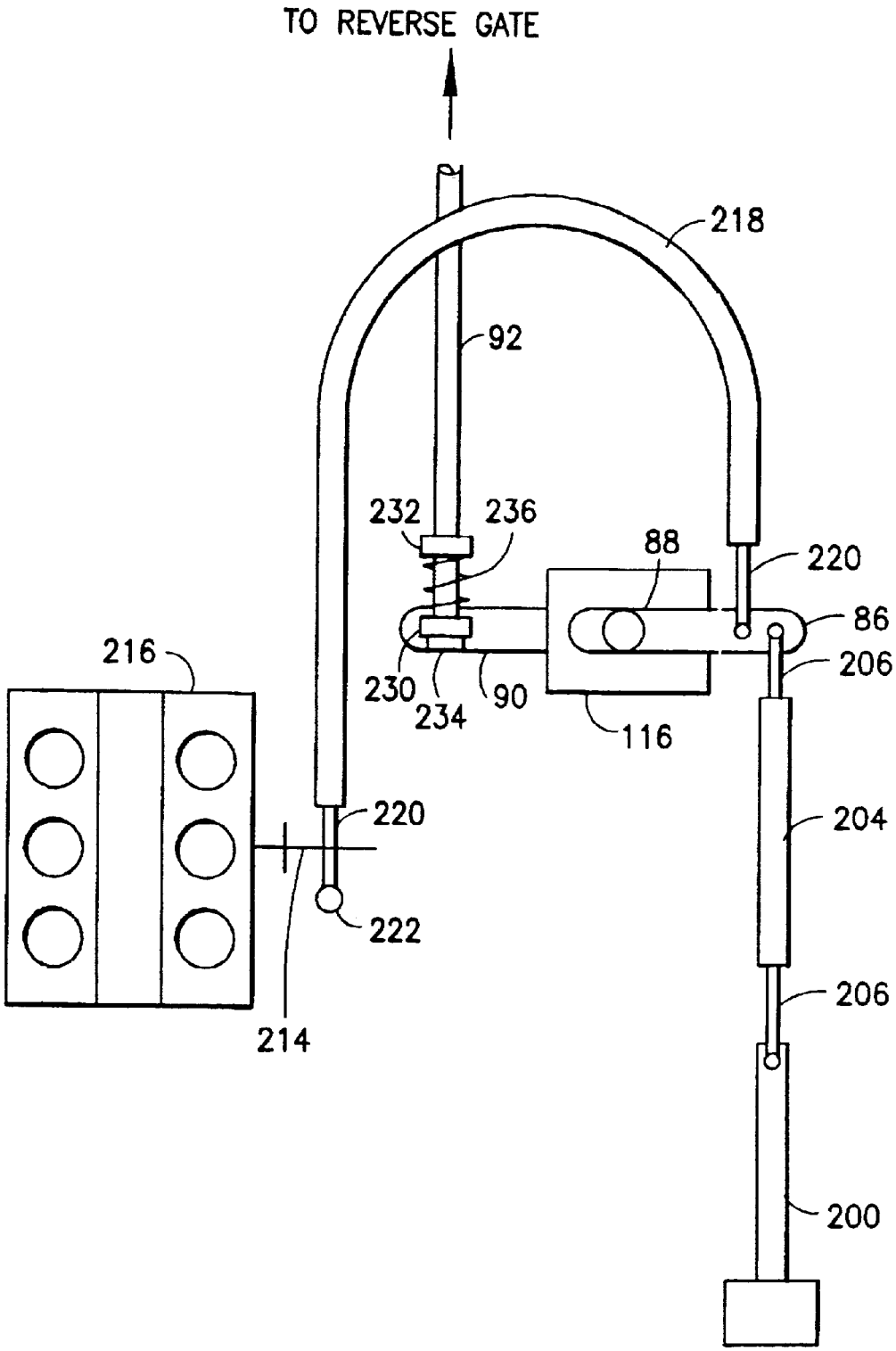
FIG. 5 is a schematic showing a plan view of a braking system in accordance with another preferred embodiment of the invention.

The braking system shown in part in FIG. 5 operates in a manner similar to the system shown in FIG. 4, with some mechanical changes. For the sake of simplicity, the throttle pedal and throttle cable have been omitted from FIG. 5. In accordance with the preferred embodiment shown in FIG. 5, control lever 86 is connected to brake cable 206 and to one end of the slave cable 220. The control lever 86 transfers motion through shaft 88 to lever 90. Lever 90 is coupled to a reverse gate actuating rod 92 via a through bracket 230 and a spring 236. The spring 236 is installed between the through bracket 230 and a flange 232 on the actuating rod 92. The rod 92 slides through the bracket 230, with a stop 234 on the end rod 92, i.e., forward of the lever 90. The stop 234 will help to lift the reverse gate for forward thrust when the lever 90 returns.

Again the spring 236 is designed to have a threshold compressive force which is greater than the operating load required to deploy the reverse gate. The brake pedal is pivoted from a first position to a second position corresponding to full deployment of the reverse gate. Only when the reverse gate is fully deployed and the actuating rod 234 is stopped, will the spring 236 start to compress. The spring undergoes compression as the brake pedal moves to a third position beyond the second position. Again the distance corresponding to the lost motion of the ball 222 is approximately equal to the amount that the slave cable 220 displaces as the brake pedal moves from the first position to the second position. At the latter point, the ball 222 engages the throttle 214. The throttle is then increasingly opened as the brake pedal 200 is moved to the third position, causing the ball 222 to displace while engaging the throttle. Again the engine speeds up, causing the impeller to produce a flow of water which is discharged out the steering nozzle and reversed by the fully deployed reverse gate. The resulting braking thrust causes the boat to decelerate.

In accordance with the preferred embodiments, each cable comprises a flexible strand of heavy wire and each other casing comprises a long spring having polyethylene tubing stuffed down its center, a rubber coating being applied on the exterior to provide watertightness. Both ends of each outer casing are anchored using conventional fittings.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A jet-propelled boat comprising:

a water jet propulsion system having an inlet and an outlet;

a reverse gate movable between a forward shift position and a reverse shift positions, said reverse gate in said forward shift position being removed from the path of water exiting said outlet and in said reverse shift position being in the path of water exiting said outlet;

a helm control mount;

a brake pedal mounted to said helm control mount, said brake pedal being movable between a first position and a second position relative to said helm control mount;

a first mechanical system linking said brake pedal to said reverse gate, said first mechanical system being arranged so that said reverse gate is moved from said forward shift position to said reverse shift position in response to said brake pedal being pivoted from said first position to said second position, wherein said first mechanical system comprises a pivotable control lever, a cable assembly for coupling said control lever to said brake pedal, and an actuating rod for coupling said reverse gate to said control lever, wherein said cable assembly comprises a spring which does not compress until a threshold compressive force is applied to said spring, said threshold compressive force being greater than the load required to move said reverse gate from said forward shift position to said reverse shift position.

2. A jet-propelled boat comprising:

a water jet propulsion system having an inlet and an outlet;

a reverse gate movable between a forward shift position and a reverse shift positions, said reverse gate in said forward shift position being removed from the path of water exiting said outlet and in said reverse shift position being in the path of water exiting said outlet;

a helm control mount;

a brake pedal mounted to said helm control mount, said brake pedal being movable between a first position and a second position relative to said helm control mount;

a first mechanical system linking said brake pedal to said reverse gate, said first mechanical system being arranged so that said reverse gate is moved from said forward shift position to said reverse shift position in response to said brake pedal being pivoted from said first position to said second position; and an engine comprising a throttle, wherein said first mechanical system also links said brake pedal to said throttle, said first mechanical system being further arranged so that the degree to which said throttle is open increases in response to said brake pedal being moved to a third position beyond said second position.

3. The boat as recited in claim 2 wherein said brake pedal is pivotably mounted to said helm control mount.

4. The boat as recited in claim 2 wherein said first mechanical system comprises a pivotable control lever, a cable assembly for coupling said control lever to said brake pedal, and an actuating rod for coupling said reverse gate to said control lever.

5. The boat as recited in claim 2, wherein said first mechanical system comprises a pivotable control lever having a pivot axis, a cable connector, a first cable having one end coupled to said brake pedal and another end coupled to said cable connector, and a spring arranged between said cable connector and said control lever so that a compressive force is applied to said spring when said brake pedal is moved to said third position, wherein said spring does not compress until a threshold compressive force is applied to said spring, said threshold compressive force being greater than the load required to move said reverse gate from said forward shift position to said reverse shift position.

6. The boat as recited in claim 5, wherein said first mechanical system further comprises a second cable having one end coupled to said cable connector and another end coupled to said throttle only after an amount of lost motion of said second cable while said brake pedal is moved from said first position to said second position.

7. The boat as recited in claim 6, wherein said second cable comprises a ball on said other end, said ball being coupled to said throttle only after said lost motion.

8. The boat as recited in claim 2, wherein said first mechanical system comprises a pivotable control lever, a first cable for coupling said control lever to said brake pedal, and a second cable for coupling said control lever to said throttle only after an amount of lost motion of said second cable while said brake pedal is moved from said first position to said second position.

9. The boat as recited in claim 8, wherein said first mechanical system further comprises an actuating rod having one end coupled to said reverse gate, and a spring arranged at a position intermediate the other end of said actuating rod and said control lever so that a compressive force is applied to said spring when said brake pedal is moved from said first position to said second position, wherein said spring does not compress until at least a threshold compressive force is applied to said spring, said threshold compressive force being greater than the load required to move said reverse gate from said forward shift position to said reverse shift position.

10. A system for braking a jet-propelled boat, comprising:

an engine comprising a throttle;

a water jet propulsion system having an inlet and an outlet;

a reverse gate;

a brake pedal; and mechanical means for deploying said reverse gate behind said outlet in response to said brake pedal being moved from a first position to a second position, and then opening said throttle in response to said brake pedal being moved to a third position beyond said second position, wherein said mechanical means comprise a spring arranged so that a compressive force is applied to said spring when said brake pedal is moved from said second position to said third position, wherein said spring does not compress until at least a threshold compressive force is applied to said spring, said threshold compressive force being greater than the load required to deploy said reverse gate.

11. A system for braking a jet-propelled boat, comprising:

an engine comprising a throttle;

a water jet propulsion system having an inlet and an outlet;

a reverse gate;

a brake pedal; and mechanical means for deploying said reverse gate behind said outlet in response to said brake pedal being moved from a first position to a second position, and then opening said throttle in response to said brake pedal being moved to a third position beyond said second position, wherein said mechanical means comprise:

a pivotable control lever having a first range of pivoting while said brake pedal moves from said first position to said second position and a second range of pivoting while said brake pedal moves from said second position to said third position; and an actuating rod which displaces in response to said control lever pivoting in said first range and which does not displace during pivoting of said control lever in said second range, said actuating rod being coupled to said reverse gate.

12. The system as recited in claim 11, wherein said mechanical means further comprises:

a brake cable having a first range of displacement while said brake pedal moves from said first position to said second position and a second range of displacement while said brake pedal moves from said second position to said third position;

a slave cable which is slaved to said brake cable; and a mechanical element attached to one end of said slave cable, said mechanical element being coupled to said throttle during displacement of said brake cable in said second range but not in said first range.

13. A system for braking a jet-propelled boat, comprising:

an engine comprising a throttle;

a water jet propulsion system having an inlet and an outlet;

a reverse gate;

a brake pedal; and mechanical means for deploying said reverse gate behind said outlet in response to said brake pedal being moved from a first position to a second position, and then opening said throttle in response to said brake pedal being moved to a third position beyond said second position, wherein said mechanical means comprise:

a brake cable having a first range of displacement while said brake pedal moves from said first position to said second position and a second range of displacement while said brake pedal moves from said second position to said third position;

a pivotable control lever which pivots in response to said brake cable displacing in said first range and which does not pivot during displacement of said brake cable in said second range; and an actuating rod having one end coupled to said control lever and the other end coupled to said reverse gate.

14. A jet-propelled boat comprising a brake pedal, a reverse gate actuated by said brake pedal, an engine throttle actuated by said brake pedal, and a mechanical system actuating said reverse gate in response to actuation of said brake pedal and delaying actuation of said engine throttle until after actuation of said reverse gate.

15. The boat as recited in claim 14, wherein said mechanical system comprises a spring arranged so that a compressive force is applied to said spring when said brake pedal is actuated, said spring having a sufficiently high speed rate that said spring does not compress until at least a threshold compressive force is applied via said brake pedal, said threshold compressive force being greater than the load required to actuate said reverse gate.

16. The boat as recited in claim 14, wherein said mechanical system comprises a slave cable which couples said engine throttle to said brake pedal after execution of a range of lost motion.

17. A system for actuating a reverse gate, comprising:

a brake pedal;

a brake cable having one end coupled to said brake pedal;

a pivotable control lever having a portion coupled to the other end of said brake cable;

an actuating rod having one end coupled to said control lever and the other end coupled to the reverse gate, and a spring which does not compress until at least a threshold compressive force is applied which is greater than the load required to actuate said reverse gate, said actuating rod being coupled to said control lever via said spring.

18. A system for actuating a reverse gate, comprising:

a brake pedal;

a brake cable having one end coupled to said brake pedal;

a pivotable control lever having a portion coupled to the other end of said brake cable;

an actuating rod having one end coupled to said control lever and the other end coupled to the reverse gate; and a spring which does not compress until at least a threshold compressive force is applied which is greater than the load required to actuate said reverse gate, said brake cable being coupled to said control lever via said spring.

19. A system for actuating a reverse gate, comprising:

a brake pedal, a brake cable having one end coupled to said brake pedal, a pivotable control lever having a portion coupled to the other end of said brake cable, an actuating rod having one end coupled to said control lever and the other end coupled to the reverse gate, an engine throttle, and a slave cable coupled to said engine throttle and slaved to said brake cable.

* * * * *